United States Patent [19]

Owensmith

[11] 4,037,340

[45] July 26, 1977

[54] SCARF

[75] Inventor: Alan Sidney Lewis Owensmith, Epsom, England

[73] Assignee: Merchant Inventors International Limited, England

[21] Appl. No.: 657,382

[22] Filed: Feb. 10, 1976

[51] Int. Cl.[2] ..... G09F 7/00

[52] U.S. Cl. ..... 40/129 A

[58] Field of Search ..... 40/129 C, 125 F, 129 A, 40/125 R, 125 G

[56] References Cited

U.S. PATENT DOCUMENTS

| | | | |
|---|---|---|---|
| 839,501 | 12/1906 | Munro et al. | 40/125 R X |
| 3,037,311 | 6/1962 | Ross et al. | 40/125 G |

FOREIGN PATENT DOCUMENTS

| | | | |
|---|---|---|---|
| 1,562,158 | 2/1969 | France | 40/129 A |
| 1,213,347 | 3/1960 | France | 40/129 C |
| 359,805 | 10/1931 | United Kingdom | 40/129 C |
| 626,669 | 7/1949 | United Kingdom | 40/129 C |
| 848,169 | 3/1958 | United Kingdom | 40/129 C |

*Primary Examiner*—John F. Pitrelli
*Assistant Examiner*—Wenceslao J. Contreras
*Attorney, Agent, or Firm*—Cushman, Darby & Cushman

[57] ABSTRACT

A scarf which can be worn draped around the neck in the usual manner is provided in opposed end sections of its length with transverse pockets for the reception of the hands enabling the scarf to be held above the head with the part of the scarf intervening between the pockets stretched taut for the display of readable matter.

6 Claims, 3 Drawing Figures

SCARF

This invention relates to scarves for wearing.

Scarves worn at sporting events are sometimes held stretched above the head as a signal of support or encouragement to a competing team, or to celebrate the team's success on the field. This is now common practice among soccer fans, who often wear scarves bearing club colours or emblems, or the club name.

Scarves used as "banners" in that way often do not have their full display effect because when stretched above the head the scarves are longitudinally pleated or folded and it is indeed difficult to hold the scarves flat.

The present invention provides a scarf which is formed in such a way that it can easily be used as a banner in the described manner, with full display effect.

A scarf according to the invention is characterised in that opposite end sections of its length have hand-openings for receiving the user's hands while these lie generally transversely of the scarf, said hand-receiving openings providing bearing places against which hand pressure can be exerted outwardly towards the scarf ends, the spacing of such bearing places along the scarf permitting such pressure to be exerted to hold the intervening part of the scarf taut while the user holds it raised above his head.

A scarf according to the invention can be comfortably held in display position with the full width of the stretched portion of the scarf exposed to view. Moreover the user's hands can remain in position in the hand openings at times when the scarf is being worn, draped around the neck, in the customary manner. All that the user has to do in order to display the scarf in the traditional manner is to raise his arms and stretch them above his head.

The advantage of a scarf made according to the invention is not dependent on the appearance of the scarf, i.e., on its colour or pattern or on the presence of pictorial or readable matter to be displayed. However the invention is of particular value as applied to scarves bearing readable matter and in preferred embodiments of the invention the scarf bears on one or each side thereof a word or words extending along the scarf, which word or words is or are displayed along the portion of the scarf intervening between the hand openings.

For the purposes in view the opposed hand bearing places should be located nearer the ends of the scarf than its transverse centre line and symmetrically with respect to such line.

The hand-receiving openings may be defined externally of the scarf proper. For example pieces of material may be stitched or otherwise secured to one outer face of the scarf at the appropriate positions to form hand-receiving loops or pockets. Preferably however the scarf is formed in two or more plies which are unconnected along or at certain regions along one longitudinal margin of the scarf so as to leave openings via which the hands have access between the plies.

If the scarf has internal or external hand-receiving pockets, as is preferred, the pockets can be used for carrying articles. Fasteners may be provided for holding the pockets closed when used for that purpose.

It is advantageous for the scarf to have hand-receiving pockets capable of accommodating the hands while they are flat and point generally transversely across the scarf in directions which are divergent in correspondence with the divergence of the user's arms when they are holding the scarf raised and outstretched above his head. For this purpose the scarf may have suitably inclined hand-receiving pockets. However such inclination of the pockets is not essential. It is satisfactory to provide pockets which are directed normally to the longitudinal edges of the scarf, particularly if the pockets are large enough to allow the hands to be moved within them to the more comfortable divergent positions.

In preferred embodiments of the invention the hand bearing places are in the form of thumb-holds.

It is sometimes an advantage to provide a scarf with hand-receiving openings providing hand bearing places at different spacings along the scarf. For holding the scarf above the head the user can use whichever hand positions are at the more comfortable spacing for him. Another advantage is that the most comfortable position for the hands in the scarf when it is being worn is not necessarily the best position when holding the scarf displayed above the head. This partly depends on the length of the scarf.

Preferably the scarf provides at least one pair of bearing places as hereinbefore referred to which are spaced apart along the scarf by a distance of not less than 24 inches nor more than 55 inches. The preferred spacing range is from 28 to 45 inches and the optimum spacings, suitable for most adults, while affording a generous display area, are from 30 to 40 inches.

In many cases it is suitable to provide hand-receiving openings with bearing places near the ends of the scarf but with long scarves it may be more suitable for such bearing places to be set well in from the scarf ends.

A combination of features which has been found to be of value for a scarf suitable for most user's of adult size is the following: the scarf length is in excess of 50 inches and the scarf has hand openings providing at least one pair of symmetrically disposed hand bearing places spaced by a distance of from 30 to 40 inches.

The advantage of having different bearing positions for the hands can be realised if desired without providing different sets of pockets in the scarf. Thus there may be a single long pocket extending along the scarf or a long pocket extending along each of the opposed halves of the scarf length and said pocket(s) may provide pairs of bearing places at different spacings. For example one such pair may be constituted by outer pocket boundaries and another such pair may be in the form of thumb holds. Such a construction has the advantage that the user can merely slide his hands along the pocket(s) in order to engage the selected pair of bearing places.

Some embodiments of the invention, selected by way of example, will now be described with reference to the accompanying diagrammatic drawings. In these drawings.

Figure 1:
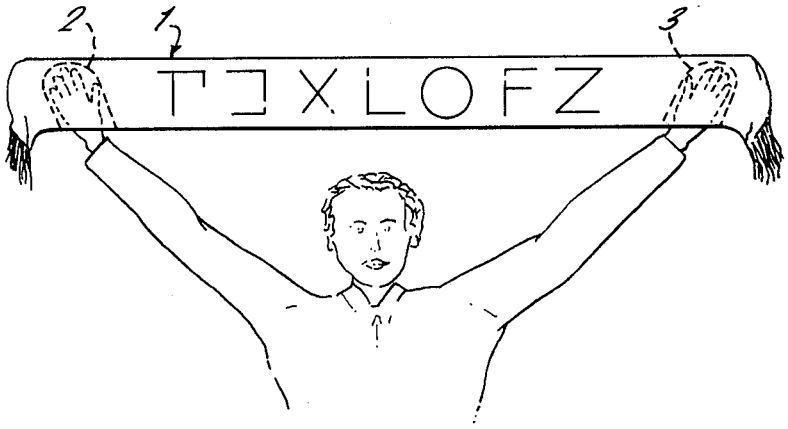
FIG. 1 shows a scarf according to the invention being displayed as a banner.

The scarf 1 shown in FIG. 1 has two hand-receiving openings 2 and 3 inset from the scarf ends. The said openings are in the form of pockets extending transversely of the scarf at an inclination to its longitudinal edges so that the pockets approximate to the divergence of the arms when raised into the positions shown in FIG. 1. Those boundaries of the pockets which are nearest the scarf ends form bearing places against which the hands can be pressed outwardly to hold the intervening portion of the scarf in taut flat condition as shown in that Figure.

In one construction of scarf as shown in FIG. 1 it is composed of one or more plies of wool, nylon, linen or any other suitable material and the pockets 2 and 3 are formed by stitching pieces of the same or a different material to one side of the scarf. In an alternative construction the scarf is double-ply and the plies are stitched together marginally, except where the hand openings are located, and along the boundaries of the pockets.

The pockets are of a size adequate to receive the whole hand of an average adult. Of course the pockets could be formed internally to fit the hands like gloves or mittens if so desired. The hands can remain in the pockets while the scarf is worn, draped around the neck. The scarf bears a name, e.g. the name of a soccer club, which is printed on or woven into the scarf material.

Figure 2:
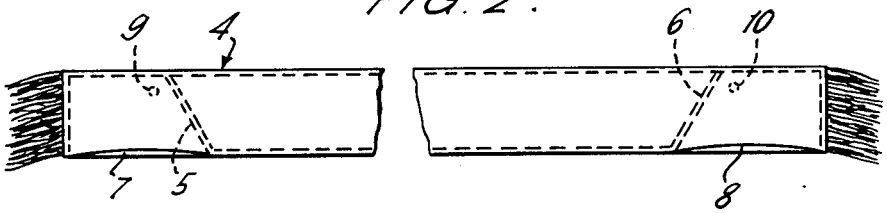
FIG. 2 shows another scarf according to the invention.
Figure 3:
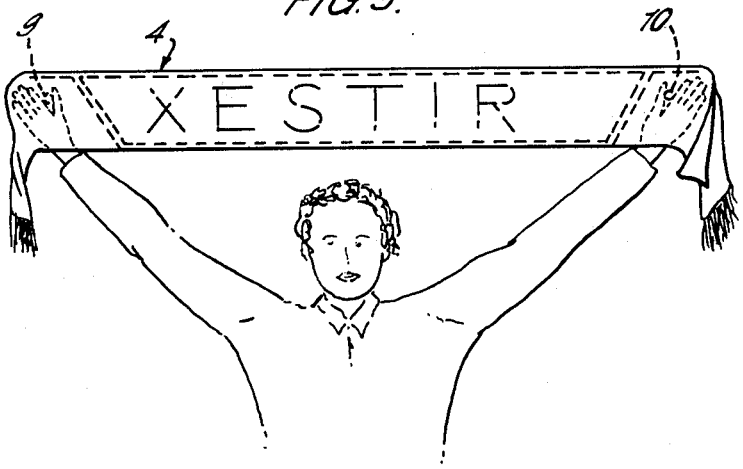
FIG. 3 shows this scarf being displayed.

FIGS. 2 and 3 shows a scarf 4 comprising two plies which are stitched together where indicated by the broken lines. The transverse rows of stitches 5 and 6 form inner boundaries of two end pockets the entrance openings of which appear at 7 and 8. These pockets have a length considerably greater than a hand's width so that when the scarf is being worn there is considerable freedom of movement of the hands along the pockets. Within the pockets there are local thumbholds 9 and 10 formed by locally stitching together the scarf plies forming the front rear walls of the pockets. These thumb-holds are at a convenient spacing for engagement by the thumbs for transmitting the stretching force to the intervening portion of the scarf when it is raised for display as shown in FIG. 3. In a particular version of the scarf represented in FIGS. 2 and 3, the scarf had a length of 55 inches and each of the thumb-holds 9 and 10 was about 11 inches from the adjacent scarf end.

It will be appreciated that various modifications of construction are possible within the scope of the invention. Thus a scarf according to FIG. 1 could have two or more pockets in each of its end portions so that there are two or more pairs of pockets at different spacings to suit different uses or different users. A scarf similar to that shown in FIGS. 2 and 3 could be formed from a single piece of material by folding it longitudinally in half and stitching the two layers of material together at their end margins and along the central portion of their free longitudinal margins. The openings for the hands between the plies could extend through the full width of the scarf and thus be open at both of its longitudinal edges.

According to another modification (not shown) of the scarf illustrated in FIGS. 2 and 3, the scarf plies are unconnected along the whole of one longitudinal margin of the scarf (the lower margin in the aspect of the figures) so as to define a single long pocket the end portions of which provide the hand openings giving access to the thumb-holds 9 and 10.

What I claim is:

1. A scarf for wearing about the neck, said scarf being generally rectangular and having a length substantially greater than its width, each of the opposed end sections of the scarf having at least one hand-receiving pocket having an open end facing a longitudinal edge of the scarf and having an opposite closed end, said pockets together providing bearing places against which hand pressure can be exerted towards the scarf ends, the spacing of such bearing places along the scarf being such that a user can let his hands bear against such places while the scarf is being worn, draped around his neck, and can then by raising his arms and moving his hands away from each other, bring the scarf into a display position in which the part of the scarf between said places is stretched taut above the user's head with the opposed surfaces of the scarf facing to the front and rear of the user, and wherein that part of the scarf bears readable matter which is legibly displayed when the scarf is in such display position.

2. A scarf according to claim 1, wherein the said distance between bearing places is not less than 24 inches nor more than 55 inches.

3. A scarf according to claim 1, wherein said pockets are located within the scarf and are defined by different layers of material thereof.

4. A scarf for wearing about the neck, said scarf being generally rectangular and having a length substantially greater than its width, the opposed halves of the length of the scarf having internal pockets which while the scarf is being worn, draped around a user's neck, can accommodate the wearer's hands while these lie flat and point generally across the scarf, and having thumb holds in said pockets and against which the user's thumbs can be pressed outwardly towards the scarf ends to hold the intervening portion of the scarf in taut condition while the user holds it raised above his head, said intervening portion of the scarf bearing readable matter which extends along the scarf and which is legibly displayed when the scarf is in such raised position.

5. A scarf according to claim 4, wherein said thumbholds are formed by local connections between different layers of material forming the front and rear walls of said pockets.

6. A scarf according to claim 4, wherein the said thumbholds are spaced along the scarf by not less than 24 inches nor more than 55 inches.

* * * * *